United States Patent [19]

Mauck

[11] Patent Number: 4,540,372

[45] Date of Patent: Sep. 10, 1985

[54] LIFE PRESERVER

[76] Inventor: Lee E. Mauck, 4020 S. 130th East Ave., Tulsa, Okla. 74134

[21] Appl. No.: 620,061

[22] Filed: Jun. 13, 1984

Related U.S. Application Data

[63] Continuation-in-part of Ser. No. 407,803, Aug. 13, 1984, Pat. No. 4,464,132.

[51] Int. Cl.[3] ..... B63C 9/08

[52] U.S. Cl. ..... 441/81

[58] Field of Search ..... 441/43, 80–85, 441/88–89, 108, 109, 129–131; 114/346

[56] References Cited

U.S. PATENT DOCUMENTS

| | | | |
|---|---|---|---|
| 1,780,986 | 11/1930 | Sipos | 441/82 |
| 2,246,108 | 6/1941 | Sermon | 441/131 |
| 2,366,303 | 1/1945 | White | 441/81 |
| 3,869,744 | 3/1975 | MacMillan et al. | 441/81 |

FOREIGN PATENT DOCUMENTS

| | | | |
|---|---|---|---|
| 84688 | 12/1954 | Norway | 441/81 |

*Primary Examiner*—Jesus D. Sotelo

*Attorney, Agent, or Firm*—Head, Johnson & Stevenson

[57] ABSTRACT

A life preserver comprising a buoyant toroidal body having spaced yieldable strap members disposed within the body and accessible through the central opening of the body, a length of strap extending around the inner periphery of the toroidal body and operably connected with the yieldable strap members whereby the strap is maintained in a normal storage position substantially adjacent the inner periphery of the toroidal body, the strap having the opposite ends thereof extending radially outwardly beyond the outer periphery of the toroidal body and through a passageway for connection with a retrieving cable whereby the rope may be moved radially inwardly against the force of the yieldable strap members to snugly engage the body of a victim disposed within the interior or central opening of the toroidal body to facilitate rescue of the victim without assist from the victim himself.

6 Claims, 12 Drawing Figures

LIFE PRESERVER

CROSS-REFERENCE TO RELATED APPLICATION

This application is a continuation-in-part of Lee E. Mauck co-pending application Ser. No. 407,803, filed Aug. 13, 1984, now U.S. Pat. No. 4,464,132 and entitled "LIFE PRESERVER".

BACKGROUND OF THE INVENTION

1. Field of the Invention

This invention relates to improvements in life saving devices and more particularly, but not by way of limitation, to a life preserver for faciltating the rescue of a substantially helpless person.

2. Description of the Prior Art

Life saving apparatus in the form of flotation devices are well known and are widely used in areas surrounding water, such as swimming pools, lakes, beaches and the like. These devices are usually carried on water craft, also, for water rescue services. The presently available devices of this type are normally buoyant members adapted to be grasped by the person being rescued, such as the well known toroidal shaped life preserver, and other apparatus such as shown in the Sipos U.S. Pat. No. 1,780,986, issued Nov. 11, 1930 and entitled "Protective Device;" Walters U.S. Pat. No. 2,088,251, issued July 27, 1937 and entitled "Lifesaving Device;" Spanner U.S. Pat. No. 2,344,652, issued March 21, 1944, and entitled "Lifesaving Apparatus;" Cornforth U.S. Pat. No. 4,056,861, issued Nov. 8, 1977, and entitled "Buoyant Life-Saving Device;" Kopcke U.S. Pat. No. 456,621, issued July 28, 1891, and entitled "Life Preserver;" Quarterman U.S. Pat. No. 831,891, issued Sep. 25, 1906, and entitled "Rescue Buoy;" Cline U.S. Pat. No. 844,580, issued Feb. 18, 1907, and entitled "Life Preservoir;" McKelvy U.S. Pat. No. 1,129,108, issued Feb. 23, 1915, and entitled "Life Preserver and Protector;" White U.S. Pat. No. 2,366,303, issued Jan. 2, 1945, and entitled "Supporting Means for Life Preservers;" Sermon U.S. Pat. No. 2,246,108, issued June 17, 1941, and entitled "Seat Attachment for Buoys;" Phillips U.S. Pat. No. 2,529,961, issued Nov. 14, 1950, and entitled "Float;" Baier U.S. Pat. No. 3,095,586, issued July 2, 1963, and entitled "Ring Buoy Life Preserver;" and the Norwegian Pat. No. 84,688 issued to Erik Mikal Jordan on Oct. 6, 1954.

The Sipos protective device is of a substantially annular configuration designed primarily for use by skaters and intended to protect skaters from immersion upon braking through the ice. The device is worn around the body and is tiltable into an inclined position so that persons may pass each other in close proximity, and is provided with an outer ring to engage the ice, and is also buoyant to support the person. In addition, a hook means may be thrown a distance on ice sufficiently solid for supporting the person, and the person may draw himself onto firm ice.

The Walters lifesaving device is of an elongated configuration having pointed ends and is sufficiently buoyant for sustaining the weight of a human body submerged in water. It is particularly designed to facilitate towing of the device through water. Cables are provided on the device which may be passed over the shoulder or the like of a lifeguard, who may then swim with arms and legs unimpeded. The loops formed by the ropes or cables may be placed around the chest and shoulders of an exhausted or half-drowned bather, and the bather may be supported by the device while the rescuer goes to the relief of others, or until the device is towed to the shore.

The Spanner lifesaving apparatus is of a substantially hollow square configuration and is of a buoyant construction. A plurality of seats are provided around the outer periphery of the device which are arranged whereby they take up a stable position when the device is in the water. A person may be supported by the float by sitting astride one of the seats. In addition, looped rops harness means to encircle persons is provided, the ropes being of a buoyant construction. The Cornforth lifesaving device is adapted to be thrown to swimmers, and consists of a buoyant member loosely confined within a net-like web. The web, also being buoyant, permits ready grasping of the device by the swimmer, and also facilitates the accurate throwing or casting of the device through a considerable distance with safety.

The White device includes an annular body having a centrally disposed and concentrically arranged waist encircling belt. The belt is secured to the inner periphery of the annular body by means of a band constructed of a flexible material which is zig-zagged by guides. The belt is also provided with a buckle for fastening the opposite ends of the belt together, the belt being adjustable for snugly engaging the waist of the person using the life preserver. After the belt has been properly adjusted about the waist of the user, the zig-zag band may be drawn taut whereby the annular body will be held in a definite spaced position with respect to the body of the user or wearer of the apparatus. The Norweigan reference relates to a life preserver having an internally disposed body engaging means secured to the body of the preserver by rope sections, one end of the body engaging means being connected with an eye which may be grasped for towing of the preserver and any person being supported thereby, the ropes being of a nonyieldable type.

These devices have certain disadvantages in that a person in distress in the water, such as a seriously injured or severely weakened person, frequently does not have the strength or ability to grasp a life-saving device, even when it is thrown or cast substantially in his exact location in the water. In addition, persons being rescued, such as in a sea-air rescue attempt, are frequently in the water at positions remote from any beach area, or the like, and it is substantially impossible for a rescuer to reach the injured person in time to prevent his drowning. Such an instance may be the result of an aircraft crash at sea. When the present available life preserver devices are thrown to the injured and weary passengers struggling for life, they may be able to hold onto the buoyant devices for a period of time, but frequently they become so weakened that they loose their grasps and slip under the water before the rescuers can reach them.

SUMMARY OF THE INVENTION

The present invention contemplates a novel life preserver which has been particularly designed and constructed for overcoming the foregoing disadvantages. The novel device comprises a body of a substantially annular configuration having an annular recess provided around the inner periphery thereof for loosely receiving a strap means therein. The opposite ends of the strap means extend outwardly through a radial passageway extending through the annular body and may be secured to a suitable hook or eye means whereby the device may be operably connected with the usual to w rope, or the like, as is well known. A plurality of circumferentially spaced internal chambers are provided in the annular body and each chamber is in open communication with the annular recess through a port, or the like. Suitable yieldable means is disposed in each of the internal chambers and extend into connection with the strap means for retaining the strap means in a normal position of engagement with the annular recess. When a suitable force is exerted on the strap means through the hook or eye means, the strap means is moved radially inwardly against the force of the yieldable means for engagement with any object which is present in the central opening of the annular body. For example, if the annular body is disposed around the torso of a person, the strap means will be drawn into tight engagement with the torso, and towing or otherwise retrieving of the annular body will result in the retrieval of the person engaged by the strap means. Of course, when the force acting on the strap means is released, the yieldable means will automatically return the strap means to the normal position thereof in the annular recess. It will be readily apparent that when the device reaches an injured person, he may place it around his body, or around an arm, or substantially any limb of the body, and upon the application of towing pressure by the towing rope secured to the hook or eye means the strap means will be pulled tightly against the portion of the person's body which is disposed within the interior of the annular lifesaving device. The preserver supporting the injured person may be towed to a rescue vessel, or may be lifted through the air to a rescuing aircraft. When the body is released from the life preserver, the elastic or yieldable nature of the strap means will return the strap means to the normal retracted position therefor. The novel life preserver is simple and efficient in operation and economical and durable in construction.

DETAILED DESCRIPTION OF THE PREFERRED EMBODIMENT

Figure 1:
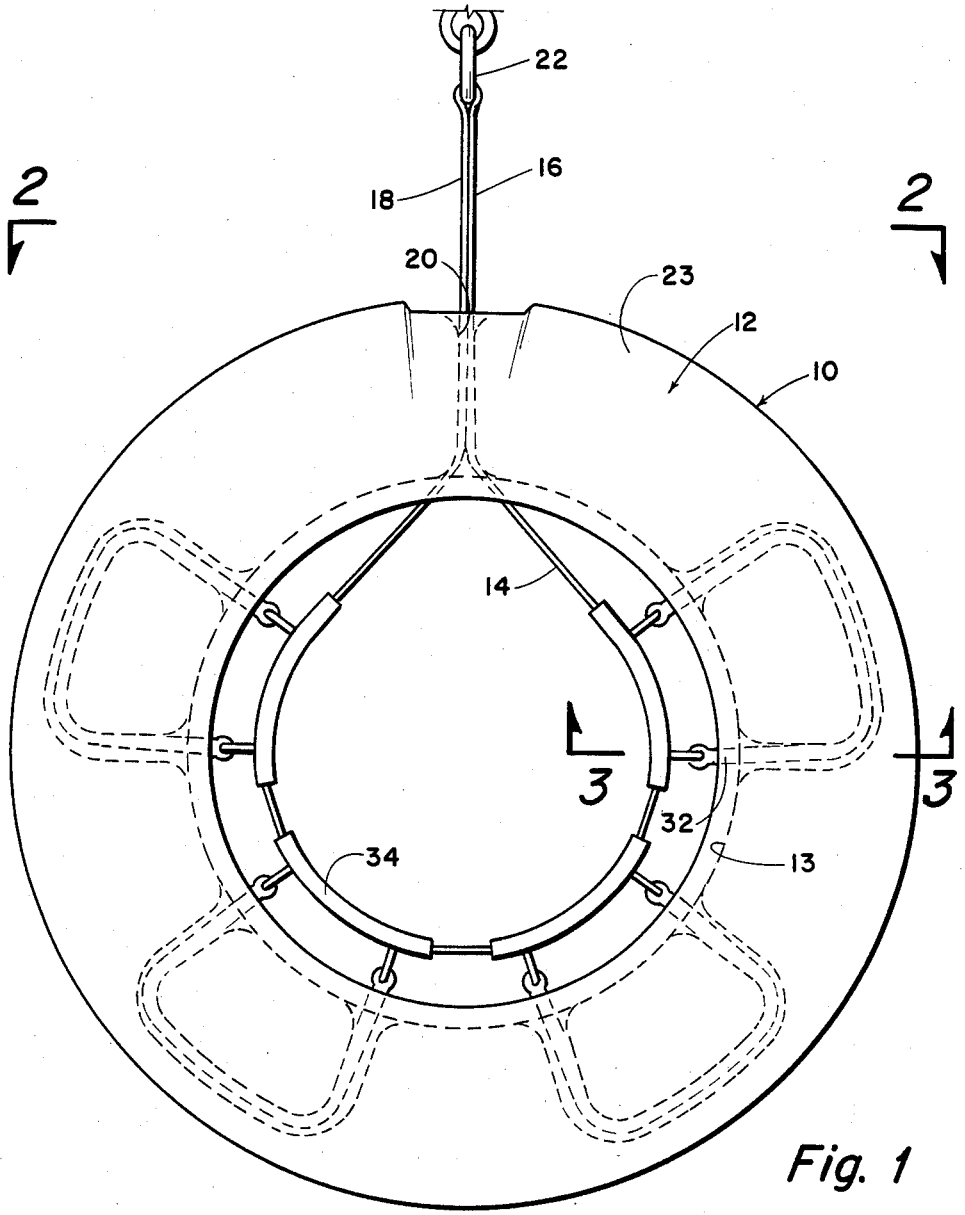
FIG. 1 is a plan view of a life preserver embodying the invention, with portions shown in broken lines for purposes of illustration, and showing one functioning position therefor.
Figure 2:
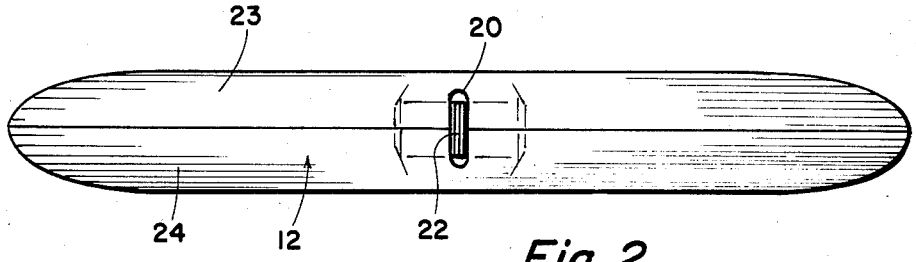
FIG. 2 is a view taken on line 2—2 of FIG. 1.

Referring to the drawings in detail, reference character 10 generally indicates a life preserver comprising an annular body 12 constructed from any suitable buoyant material and having an annular recess 13 extending around the inner periphery thereof for loosely receiving a strap means 14 therein. The strap means 14 may be of any suitable construction, such as a woven strapping material, webbing, or the like, and the opposite ends 16 and 18 thereof extend through a radially extending passageway 20 provided in the annular body 12. The ends 16 and 18 of the strap means 14 may be secured to a suitable hook or eye means 22 for connection with the usual tow rope, or the like (not shown) as is well known in devices of this type. The strap means 14 normally lies in engagement with the recess 13, and may be moved radially inwardly with respect thereto in a manner and for a purpose as will be hereinafter set forth.

The annular body 12 as shown herein is preferably of a sectional configuration comprising two annular half-sections 23 and 24 secured together in any suitable manner to form the body 12. The half-sections 23 and 24 are substantially identical but oppositely disposed with respect to one another and only one of the half-sections, such as the half-section 23, is set forth in detail herein. The half-section 23 is provided with one substantially flat face or surface 26 adapted for engagement with the corresponding flat surface of the mating half-section 24 in order that the half-sections may be secured together to form the annular body 12. Of course, one half the width of the recess 13 is provided in the half-section 23 for cooperation with the half-section 24 to form the entire recess 13, as is well known. A plurality of circumferentially spaced radially extending passageways 28 are provided in the body 23, each passageway 28 having one end thereof open to the recess 13. It may be desirable to interconnect the opposite ends of adjacent pairs of the passageways 28 with a circumferentially extending passageway 30, but not limited thereto. In addition, one-half of the passageway 20 is provided in the half-section 23 for cooperation with the half section 24 to form the passageway 20 in the body 12.

A suitable yieldable means 32, such as an elastic band of the type known as a bungee strap or cord may be disposed in each of the passageway 28, with one end of the yieldable means being accessible from the recess 13 or inner periphery of the body 12. It may be desirable to insert a single yieldable means extending longitudinally through an adjacent pair of the passageway 28 and the interconnecting passageway 30 extending therebetween, with the opposite ends of the yieldable means 32 being accessible from the recess 13 or inner periphery of the body 12. Upon uniting of the two half-sections 23 and 24, with the flat faces 26 thereof in abutting engagement, the passageways 28 of each half-section cooperate for encasing the yieldable means 32 within the body 12 with the ends of the yieldable means 32 being accessible from the interior of the body 12.

A plurality of sleeve members 34 are disposed on the strap means 14 in spaced relation along the length thereof. The sleeve members 34 may be secured to the yieldable means 32 in any suitable manner whereby the normal relaxed position of the yieldable means 32 retains the sleeve means 34 in position against the bottom of the recess 13. The engagement of the sleeve members 34 with the strap means 14 holds the strap means 14 in a normal position of engagement with the bottom of the recess 13 or at least within the recess 13 in the relaxed position of the yieldable means 32.

The sleeve members 34 may be operably connected with the yieldable means in any suitable manner, and as particularly shown herein each sleeve member 34 may be sufficiently long as to extend between an adjacent pair of passageways 28 whereby each end of the yieldable means 32 may be fastened to the sleeve 34 which is disposed in the proximity thereof. Of course, a completely independent or separate sleeve member 34 may be provided for each end of the yieldable means, or the yieldable means in each passageway 28 may comprise an independent member rather than the embodiment particularly shown herein.

Referring to FIGS. 9 through 12, whereas the sleeve members 34 may be of any suitable construction, as shown herein the sleeves 34 are of a substantially flattened tubular configuration and may be constructed from a suitable material, such as rubber, but not limited thereto. At least one aperture 36 may be provided in one wall of the sleeve 34 for facilitating connection of the sleeve 34 to the yieldable means 32. As shown herein, two apertures 36 are provided for receiving a suitable bracket means 38 therethrough. The bracket 38 may be secured to the end or ends of the yieldable means 32 in any suitable or well known manner. In addition, it may be preferable to provide a plurality of internally disposed rib members 40 in the inner periphery of the sleeve members 34 for reducing friction between the sleeves 34 and the strap means 14 during use of the apparatus 10.

Figure 3:
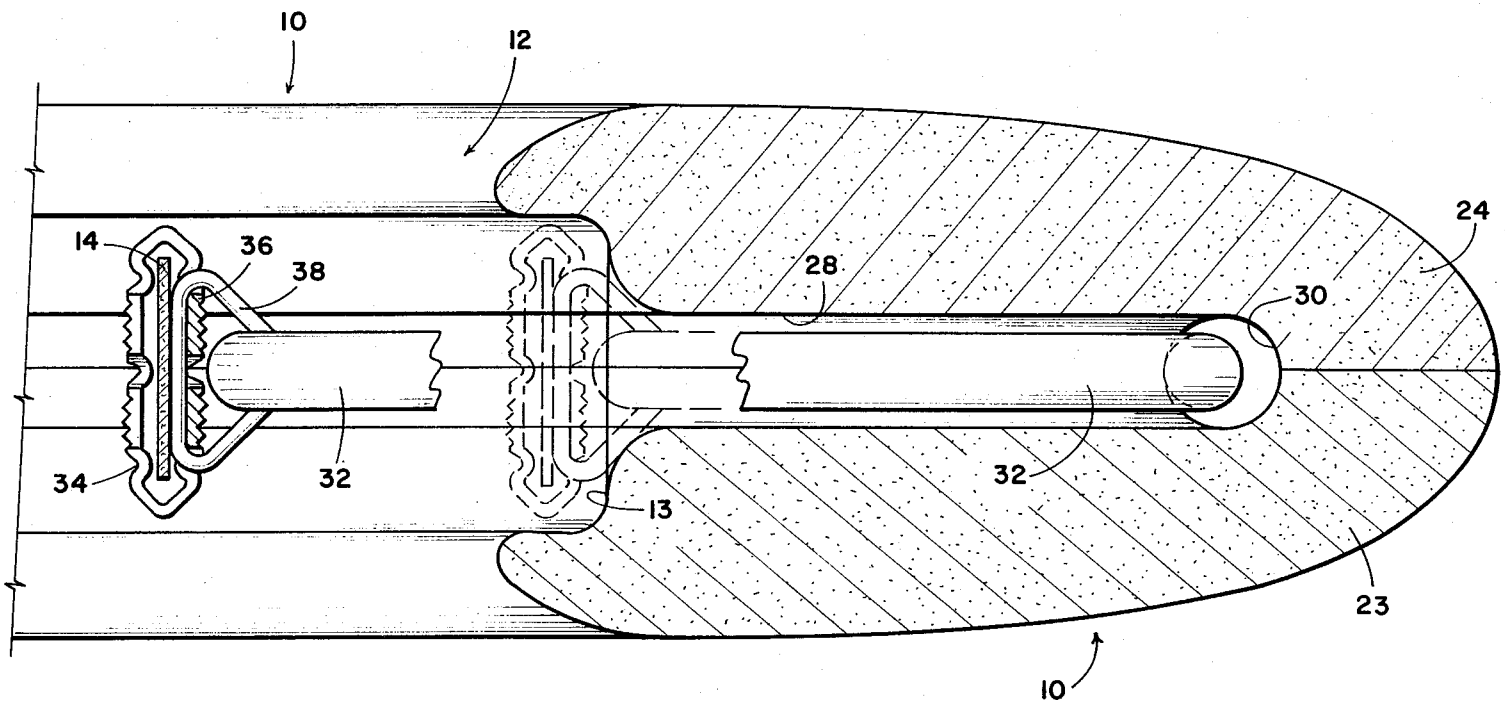
FIG. 3 is a view taken on line 3—3 of FIG. 1.
Figure 5:
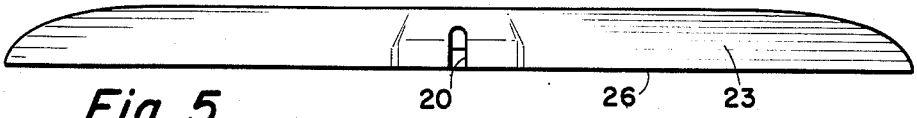
FIG. 5 is a view taken on line 5—5 of FIG. 4.
Figure 4:
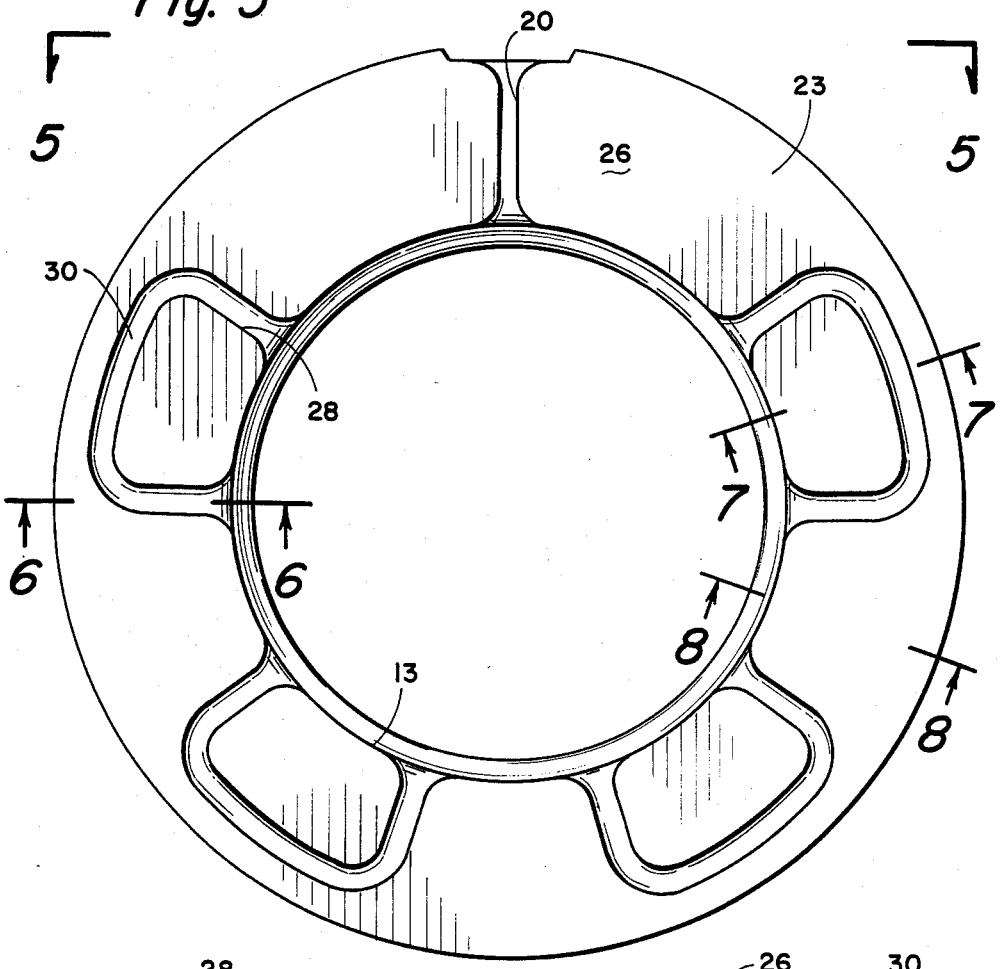
FIG. 4 is a plan view of a half-body portion of a life preserver bodying the invention.
Figure 6:
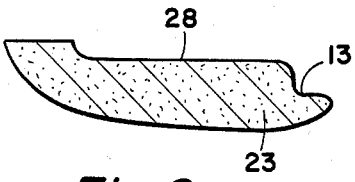
FIG. 6 is a view taken on line 6—6 of FIG. 4.
Figure 7:
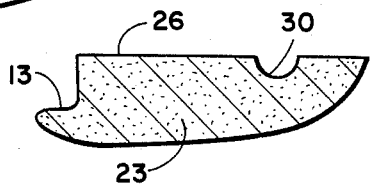
FIG. 7 is a view taken on line 7—7 of FIG. 4.
Figure 8:
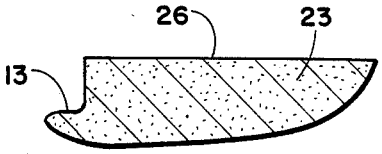
FIG. 8 is a view taken on line 8—8 of FIG. 4.
Figure 9:
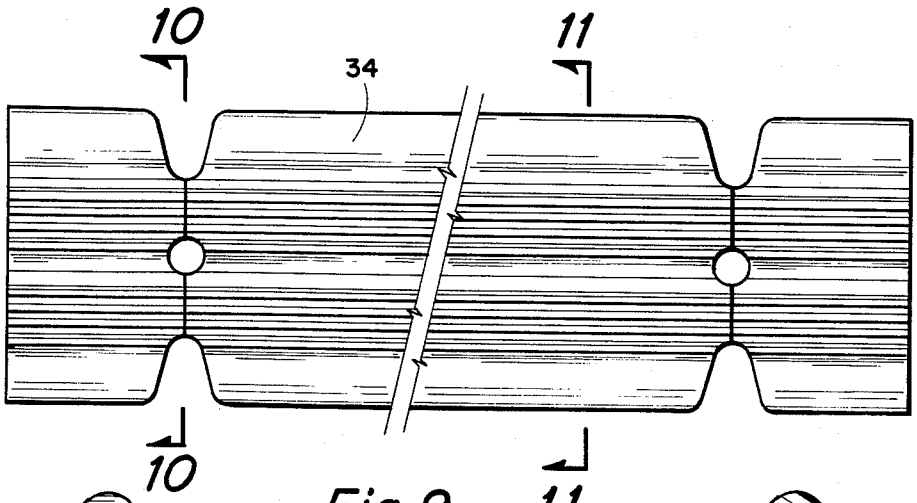
FIG. 9 is a plan view of a strap engaging element as may be used on a life preserver embodying the invention.
Figure 10:
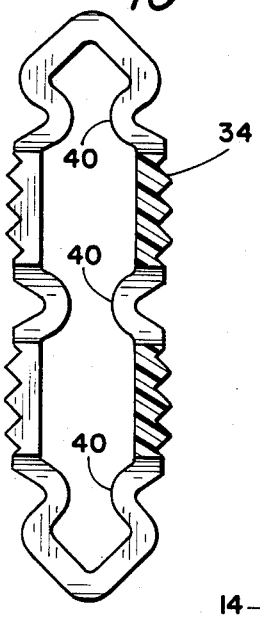
FIG. 10 is a view taken on line 10—10 of FIG. 9.
Figure 11:
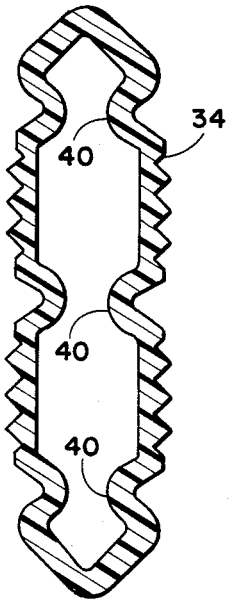
FIG. 11 is a view taken on line 11—11 of FIG. 9.
Figure 12:
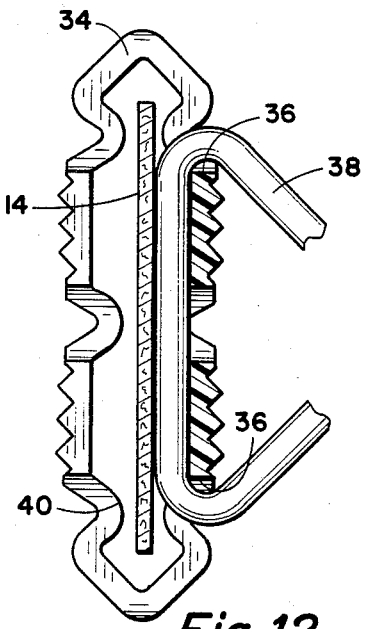
FIG. 12 is a sectional view of one type fastening means for the strap engaging element as shown in FIG. 9.

In use, the device 10 may be utilized in the normal manner of the well known toroidal life preservers, and the like, during relatively normal rescue operations wherein the conditions warrant such normal usage. However, in the event the person being retrieved or rescued has been injured to such an extent or is weakened whereby he cannot maintain a grasp or hold onto the device 10, the device may be utilized for emergency rescue in the following manner:

The device 10 may be cast, thrown, dropped, personally delivered or otherwise deposited in the proximity of the injured person whereby the device may be positioned about his body in such a manner that the toroidal configuration of the life preserver 10 surrounds his torso, or other part of his anatomy, such as an arm. The retrieving line or rope (not shown) attached to the hook or eye means 22 may be pulled for transmitting a longitudinal force along the length of the strap means 14, causing the strap means to move radially inwardly against the force of the yieldable means 32 as shown in solid lines in FIGS. 1 and 3. The strap means 14 is thus drawn tightly about the torso, or other body portion engaged by the device 10 for securely retaining injured person being rescued in the device 10, regardless of whether or not the person himself is able to grasp the device. Of course, when the rescued person is removed from the device 10, the elastic or yieldable nature of the yieldable means 32 automatically pulls or draws the strap means 14 into the normal storage position thereof against the bottom of the recess 13, or within the recess 13, or at least to an unobtrusive position with respect to the central portion of the body 12 as shown in broken lines in FIG. 3. In this manner the device 10 is in a "ready" condition for use in a subsequent rescue operation.

Such a rescue operation is of particular value in an air-sea rescue attempt in that the hoisting apparatus (not shown) normally provided in the aircraft utilized during the rescue operation may be actuated for lifting the device 10 carrying the injured person from the water and into the rescue craft. The loss of the person from the device during such a rescue operation is substantially eliminated since the device automatically clasps the person securely within the rescue device 10 until he may be retrieved by the rescue personnel.

From the foregoing, it will be apparent that the present invention provides a novel life preserver device which may be utilized in the normal manner of toroidal devices of this type, but which is particularly designed and constructed for automatically engaging the body or body portion of a victim being rescued thereby for sustaining the victim even when he is so greatly injured or is too weakened that he cannot cling to the device of his own power. The novel device comprises body grasping strap means secured within the central opening of the toroidal configuration of the life preserver by means of yieldable means whereby the application of a force along the length of the strap means draws the strap means tightly about the body or body portion of the victim for securely retaining the victim in the device until he may be retrieved therefrom. The strap means is automatically restored to a storage position upon removal of the victim therefrom whereby the device is in a "ready" condition for the next succeeding rescue operation.

Whereas the present invention has been described in particular relation to the drawings attached hereto, it should be understood that other and further modifications, apart from those shown or suggested herein may be made within the spirit and scope of this invention.

What is claimed is:

1. A life preserver comprising a buoyant toroidal body, yieldable means disposed within the body and accessible from the inner periphery of the body, strap means encircling the inner periphery of the toroidal body and operably secured to the yieldable means whereby the strap means is maintained in a normal position in the proximity of the inner periphery of the body, radially extending passageway means provided in the body and having the opposite ends open to the inner and outer peripheries of the toroidal body, the strap means having outer ends extending slidably through the passageway means and terminating exteriorly of the body, and means engagable with the outer ends of the strap means for selectively drawing the strap means radially inwardly against the force of the yieldable means for secure engagement with a victim disposed within the interior of said toroidal body.

2. A life preserver as set forth in claim 1 wherein the yieldable means comprises a plurality of elastic cord means circumferentially disposed in spaced relation around the toroidal body, each cord means having at least one end thereof accessible from the inner periphery of the body for engagement with the strap means to maintain the strap means in the normal position thereof in the proximity of the inner periphery of the body.

3. A life preserver as set forth in claim 2 and including means interposed between the said one end of each elastic cord means and the strap means adjacent thereto for operably securing the elastic cord means to the strap means.

4. A life preserver as set forth in claim 2 wherein the means interposed between the elastic cord means and strap means comprises sleeve means secured to said one end of each elastic rod means and slidably disposed on the strap means.

5. A life preserver as set forth in claim 1 and including annular recess means provided on the inner periphery of the toroidal body for receiving the strap means therein in the normal position of the strap means.

6. A life preserver as set forth in claim 1 wherein the yieldable means comprises a plurality of elastic cord means encased in the toroidal body and disposed in circumferentially spaced relation therein, each end of each cord means accessible from the inner periphery of the toroidal body for operable connection with the strap means.

* * * * *